US008827735B2

(12) United States Patent
Shimizu et al.

(10) Patent No.: US 8,827,735 B2
(45) Date of Patent: Sep. 9, 2014

(54) CONNECTOR

(75) Inventors: Tomohiko Shimizu, Makinohara (JP); Akihiro Tsuruta, Fujieda (JP)

(73) Assignee: Yazaki Corporation, Tokyo (JP)

( * ) Notice: Subject to any disclaimer, the term of this patent is extended or adjusted under 35 U.S.C. 154(b) by 179 days.

(21) Appl. No.: 13/574,422

(22) PCT Filed: Jan. 20, 2011

(86) PCT No.: PCT/JP2011/050990

§ 371 (c)(1),
(2), (4) Date: Jul. 20, 2012

(87) PCT Pub. No.: WO2011/090120

PCT Pub. Date: Jul. 28, 2011

(65) Prior Publication Data

US 2012/0289099 A1 Nov. 15, 2012

(30) Foreign Application Priority Data

Jan. 22, 2010 (JP) ..... 2010-012327

(51) Int. Cl.
*H01R 13/62* (2006.01)
*H01R 43/26* (2006.01)
*H01R 13/627* (2006.01)

(52) U.S. Cl.
CPC ..... *H01R 43/26* (2013.01); *H01R 13/6278* (2013.01)
USPC ..... 439/310

(58) Field of Classification Search
USPC ..... 439/310, 341, 834, 912
See application file for complete search history.

(56) References Cited

U.S. PATENT DOCUMENTS

| | | | | |
|---|---|---|---|---|
| 1,188,568 | A * | 6/1916 | Smith | 439/310 |
| 3,267,565 | A * | 8/1966 | Stuhler | 29/749 |
| 5,419,711 | A * | 5/1995 | Noro et al. | 439/310 |
| 5,429,519 | A * | 7/1995 | Murakami et al. | 439/310 |
| 6,390,861 | B1 * | 5/2002 | DeFrance | 439/783 |

(Continued)

FOREIGN PATENT DOCUMENTS

| | | | |
|---|---|---|---|
| CN | 1700526 | A | 11/2005 |
| JP | 5725487 | A | 2/1982 |
| JP | 56776 | U | 1/1993 |
| JP | 2002359028 | A | 12/2002 |

OTHER PUBLICATIONS

Office Action, dated Nov. 5, 2013, issued by the Japanese Patent Office in counterpart Japanese Application No. 2010-012327.

(Continued)

*Primary Examiner* — James Harvey
(74) *Attorney, Agent, or Firm* — Sughrue Mion, PLLC

(57) ABSTRACT

A connector 1 includes female and male connectors 10 and 20. In the female connector 10, a female side pressure operating surface 13 is provided on which a first working surface 41 of a nipping tool 40 abuts to receive a force in a fitting direction of the female connector 10. In the male connector 20, a male side pressure operating surface 24 is provided on which a second working surface 42 of the nipping tool 40 abuts to receive a force in the first working surface 41 side of the nipping tool 40. The first working surface 41 of the nipping tool 40 is allowed to come close to the second working surface 42 to fit the female connector 10 to the male connector 20.

4 Claims, 10 Drawing Sheets

(56) References Cited

U.S. PATENT DOCUMENTS

| | | | | |
|---|---|---|---|---|
| 6,802,727 | B2 * | 10/2004 | Geilow et al. | 439/160 |
| 7,277,294 | B2 * | 10/2007 | Carlson | 361/727 |
| 7,645,150 | B1 * | 1/2010 | Chang | 439/157 |
| 7,901,237 | B2 * | 3/2011 | Abe et al. | 439/354 |
| 8,608,507 | B2 * | 12/2013 | Van Swearingen et al. | 439/578 |
| 2002/0182918 | A1 | 12/2002 | Okabe et al. | |
| 2005/0260883 | A1 | 11/2005 | Aihara et al. | |
| 2010/0210127 | A1 * | 8/2010 | Matsumura et al. | 439/157 |
| 2012/0289099 | A1 * | 11/2012 | Shimizu et al. | 439/834 |

OTHER PUBLICATIONS

International Search Report dated Feb. 15, 2011 from the International Searching Authority in counterpart application No. PCT/JP2011/050990.

Written Opinion dated Feb. 15, 2011 from the International Searching Authority in counterpart application No. PCT/JP2011/050990.

Communication dated Apr. 11, 2014 from the State Intellectual Property Office of P.R. China in a counterpart application No. 201180006677.0.

Communication from the Japanese Patent Office drafted Mar. 26, 2014, in a counterpart Japanese application No. 2010-012327.

* cited by examiner

CONNECTOR

CROSS REFERENCE TO RELATED APPLICATIONS

This application is a National Stage of International Application No. PCT/JP2011/050990 filed Jan. 20, 2011, claiming priority based on Japanese Patent Application No. 2010-012327, filed Jan. 22, 2010, the contents of all of which are incorporated herein by reference in their entirety.

TECHNICAL FIELD

The present invention relates to a connector to which a connector is fitted by using a nipping tool.

BACKGROUND ART

Usually, in order to fit a male housing to a female housing, for instance, a lever type connector is proposed which is disclosed in JP-A-2002-359028 (patent literature 1). In this lever type connector, male and female housings are fitted to each other by using an operation of a lever that the lever rotates on one side as a supporting point so that an assured fitting operation may be achieved.

As shown in FIGS. 8 to 11, the lever type connector 100 includes a male housing 113, a lever 115 which has a part between one side and the other side in the longitudinal direction connected to the male housing 113 so as to freely rotate, a connecting part 117 which connects the lever 115 to the male housing 113 and a female housing 119 in which the male housing 113 is accommodated and fitted.

In the lever type connector 100, in the above-described connecting part 117, protruding parts 133 and 133 are respectively engaged with engaging holes 123 and 123 to connect the part of the lever 115 between the one side and the other side to the male housing 113 and rotate the lever 115 on the protruding parts 133 and 133 as axes.

Then, when the male housing 113 is fitted to the female housing 119, engaging protrusions 125 and 125 of the lever 115 are engaged with engaging stepped parts 129 and 129 of engaging grooves 131 and 131 of the female housing 119 to form supporting points. An operating part 120 of the lever 115 is pressed downward as a front end side of a fitting direction of the male housing 113 and the female housing 119 and rotated.

At this time, a force is applied to the protruding parts 133 and 133 provided in the male housing 113 by the operation of a lever of the rotating lever 115 and a pressing force that presses the operating part 120 to directly press the male housing 113, so that the male housing 113 moves downward as a whole. As a result, the male housing 113 is fitted to a hood part 127 of the female housing.

LITERATURE OF RELATED ART

Patent Literature

Patent Literature 1: JP-A-2002-359028

SUMMARY OF THE INVENTION

Problems that the Invention is to Solve

However, in the above-described usual lever type connector 100, since the lever 115 is engaged with the female housing 119 as the supporting point and the lever 115 is pressed downward to rotate the lever 115 so that the male and female housings 113 and 119 are fitted to each other, a problem arises that many component parts are provided for engaging the lever 115 to increase processes for managing the component parts and increase a production cost.

Further, in the usual lever type connector 100, since the lever 115 is rotated to fit the male and female housings 113 and 119 to each other, when the male housing 113 is once fitted to the female housing 119, the lever 115 is not used any more and attached to the lever type connector 100 as it is. Thus, a problem arises that the weight of the component parts increase.

Thus, the present invention is devised to solve the above-described usual problems and it is an object of the present invention to provide a connector in which the number of component parts is small, the weight of the component parts is not large and a production cost can be reduced.

Means for Solving the Problems

In order to achieve the above-described object, the invention defined in claim 1 provides a connector having female and male connectors. In one connector of the female and male connectors, one pressure operating surface is provided on which a first working surface of a nipping tool abuts to receive a force in a fitting direction of the female and male connectors. In the other connector, the other pressure operating surface is provided on which a second working surface of the nipping tool abuts to receive a force in the first working surface side of the nipping tool. The first working surface of the nipping tool is allowed to come close to the second working surface to fit the female connector to the male connector.

In the invention defined in claim 2, a boss part protrudes in one of the female and male connectors. In the other connector, a guide groove part is formed in which the boss part is inserted to guide the one connector in a normal fitting direction during a fitting operation by the nipping tool.

In the invention defined in claim 3, in one of the female and male connectors, a female temporarily engaging part is provided which is engaged with the other connector. In the other connector, a male temporarily engaging part is provided with is engaged with the female temporarily engaging part to hold the female and male connectors in a temporarily engaged state.

In the invention defined in claim 4, in at least one of the one pressure operating surface and the other pressure operating surface, a non-slip worked surface is formed on a surface.

Advantages of the Invention

According to the invention defined in a first aspect, in the one connector of the female and male connectors, since the one pressure operating surface is provided on which the first working surface of the nipping tool abuts to receive the force in the fitting direction of the female and male connectors. In the other connector, the other pressure operating surface is provided on which the second working surface of the nipping tool abuts to receive a force toward the first working surface side of the nipping tool. The first working surface of the nipping tool is allowed to come close to the second working surface to fit the female connector to the male connector. Accordingly, after the female and male connectors are fitted to each other, since the nipping tool is detached from the female and male connectors, the weight of the component parts of the connector can be reduced.

Further, since the nipping tool is detached after the female and male connectors are fitted to each other, component parts for engaging the nipping tool after the fitting operation are fitted can be eliminated.

Accordingly, the connector can be provided in which the number of the component parts and the weight of the component parts are smaller than the usual lever type connector with the lever kept attached after the female and male connectors are fitted to each other and a production cost can be reduced.

Further, according to the invention defined in a second aspect, the boss part protrudes in the one of the female and male connectors. In the other of the female and male connectors, the guide groove part is formed into which the boss part is inserted to guide the one connector in the normal fitting direction during the fitting operation by the nipping tool. Accordingly, the female and male connectors are not slanted and the one connector is guided along the normal fitting direction. Thus, a fitting workability can be improved.

According to the invention defined in a third aspect, in one connector of the female and male connectors, the female temporarily engaging part is provided which is temporarily engaged with the other connector. In the other connector, the male temporarily engaging part is provided which is engaged with the female temporarily engaging part to hold the female and male connectors in the temporarily engaged state. Accordingly, since the female and male connectors are held in the temporarily engaged position, the nipping tool can be easily attached.

Further, according to the invention defined in a fourth aspect, the non-slip worked surface is formed on the surface in at least one of the one pressure operating surface and the other pressure operating surface. Accordingly, the first working surface and the second working surface of the nipping tool can be allowed to easily abut on the pressure operating surfaces. Further, the strength of the female and male connectors can be improved when the female and male connectors are pressed.

MODE FOR CARRYING OUT THE INVENTION

Figure 1:
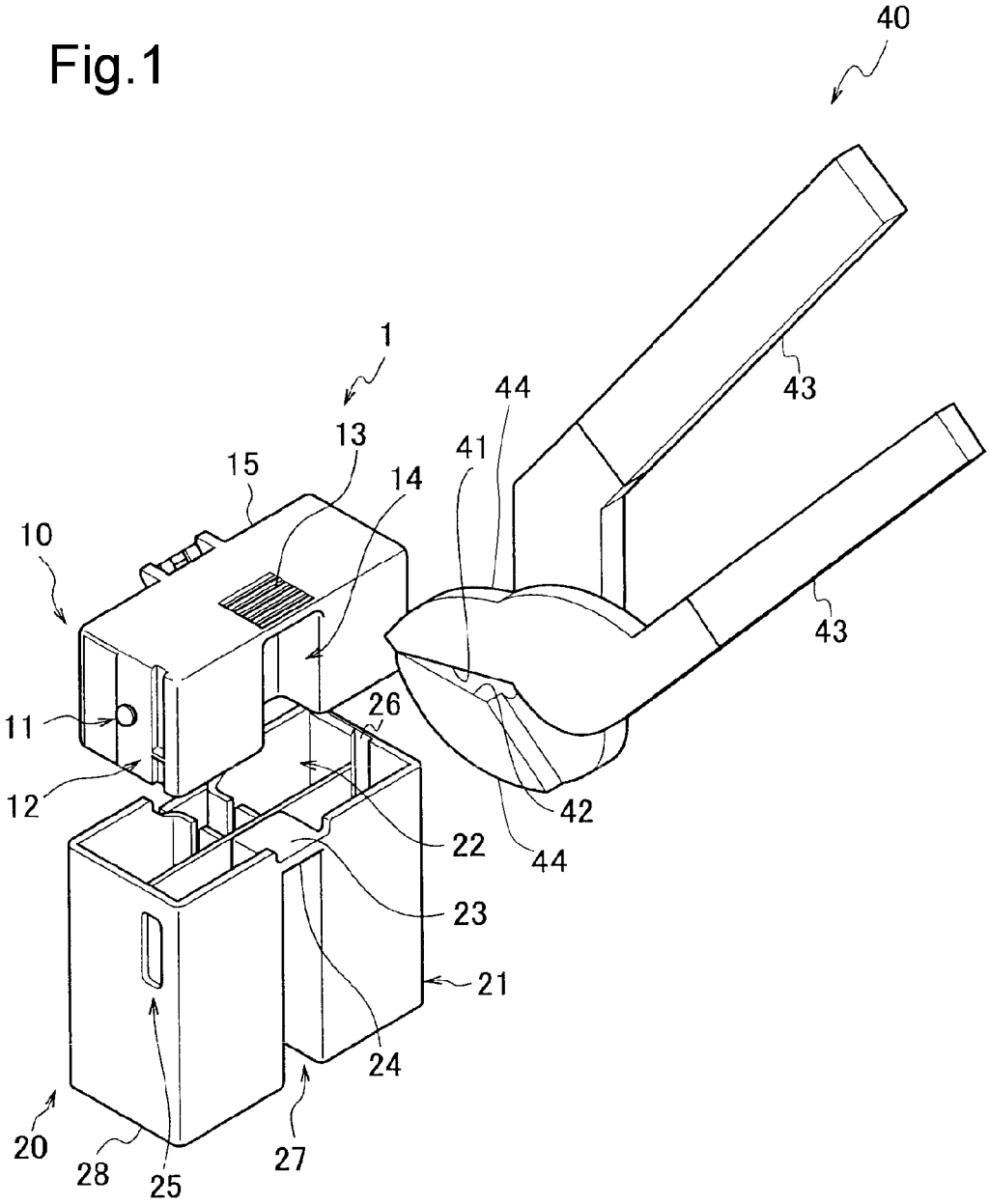
FIG. 1 is a perspective view of a nipping tool and a connector according to an exemplary embodiment of the present invention.
Figure 2:
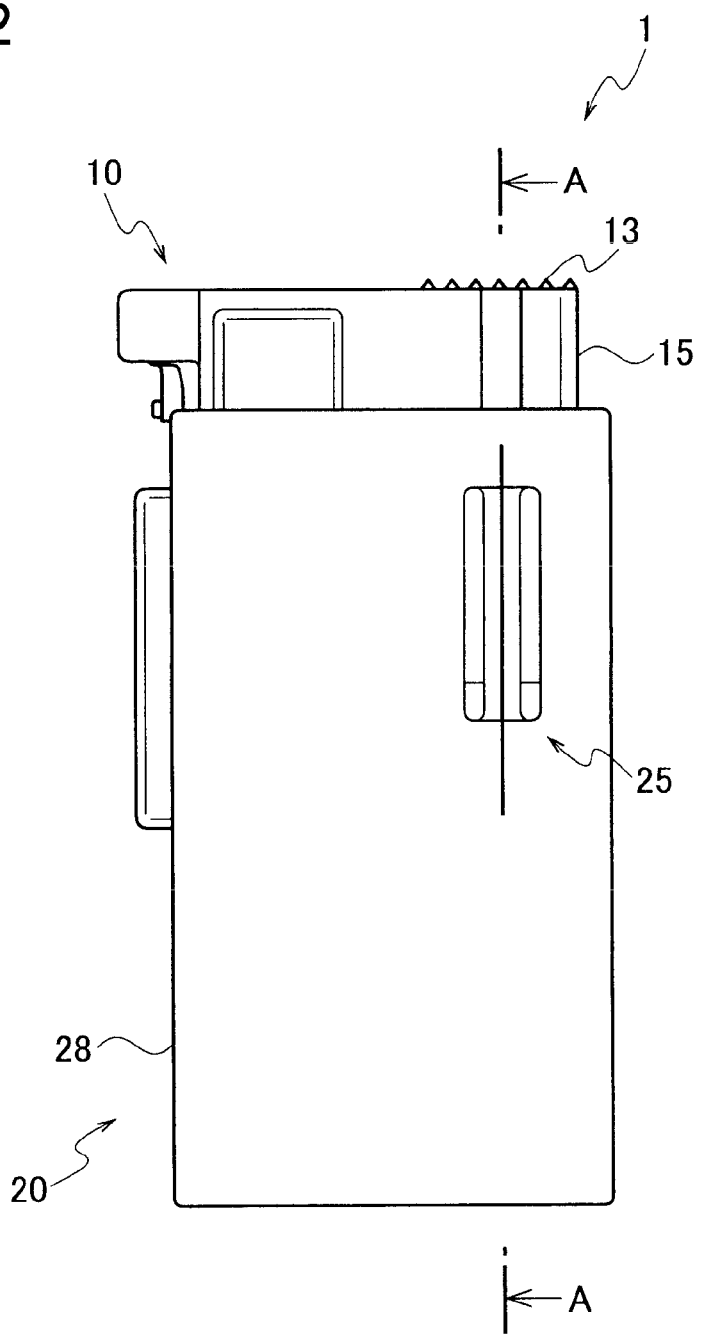
FIG. 2 is a side view of male and female connectors according to the exemplary embodiment of the present invention.
Figure 3:
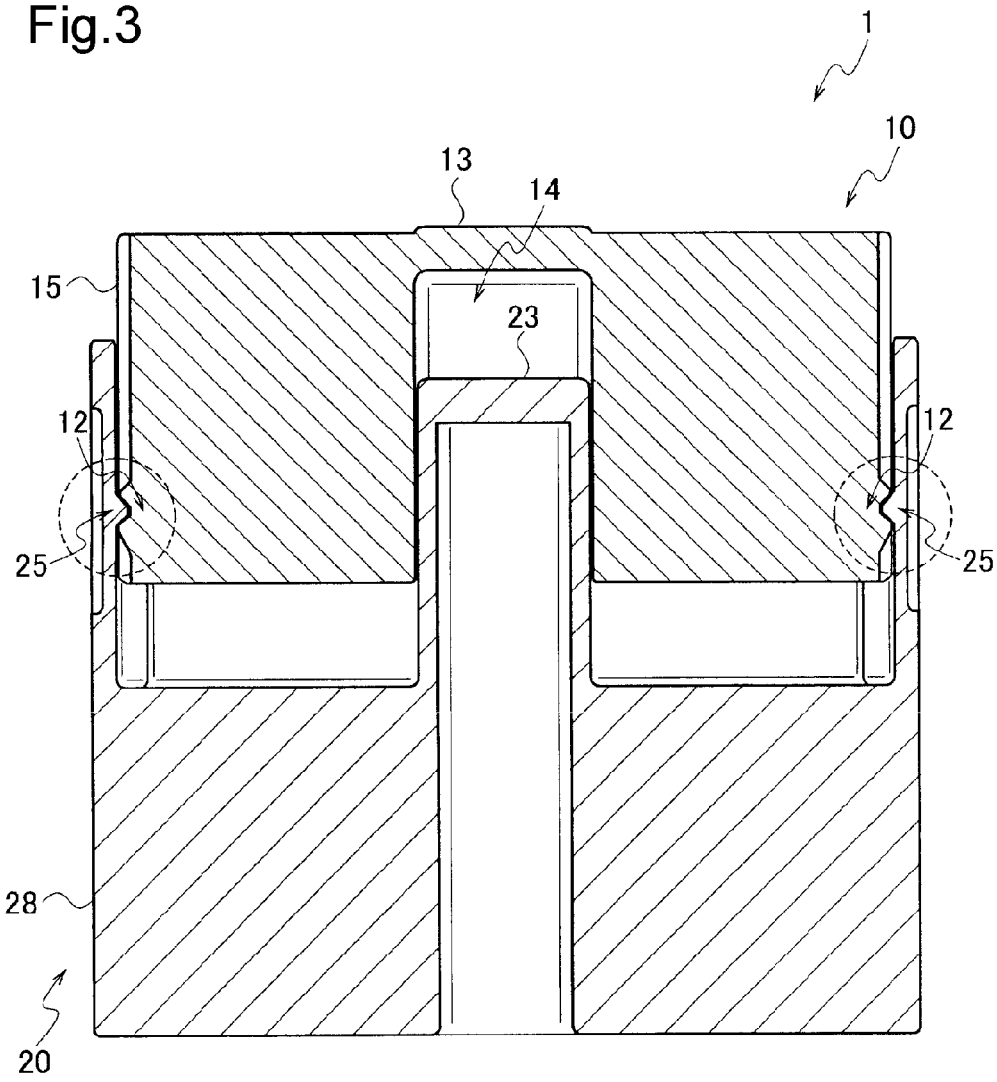
FIG. 3 is a sectional view of the female and male connectors according to the exemplary embodiment of the present invention taken along a line A-A in FIG. 2.
Figure 4:
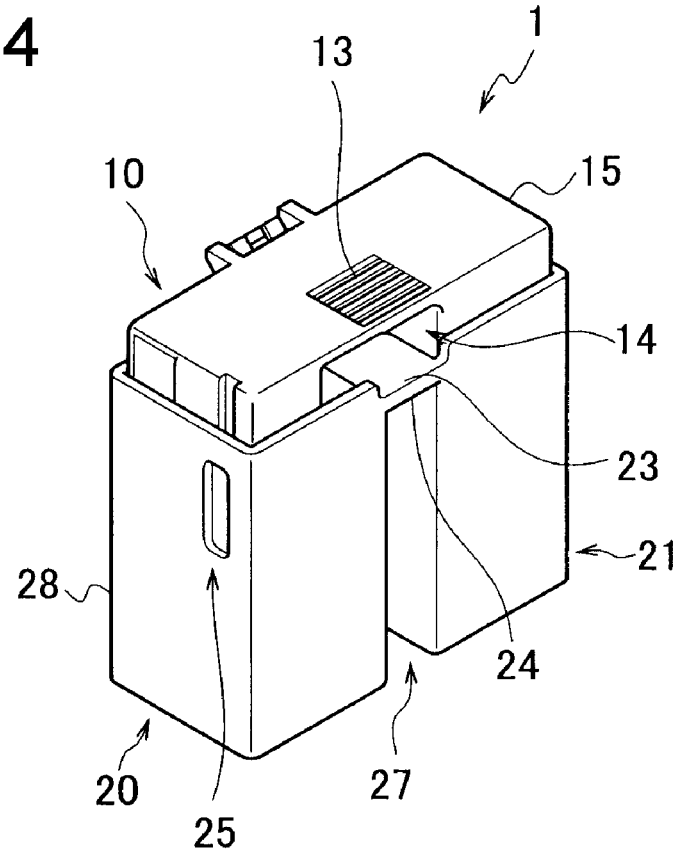
FIG. 4 is a diagram showing a temporarily engaged state of the male and female connectors according to the exemplary embodiment of the present invention.
Figure 5:
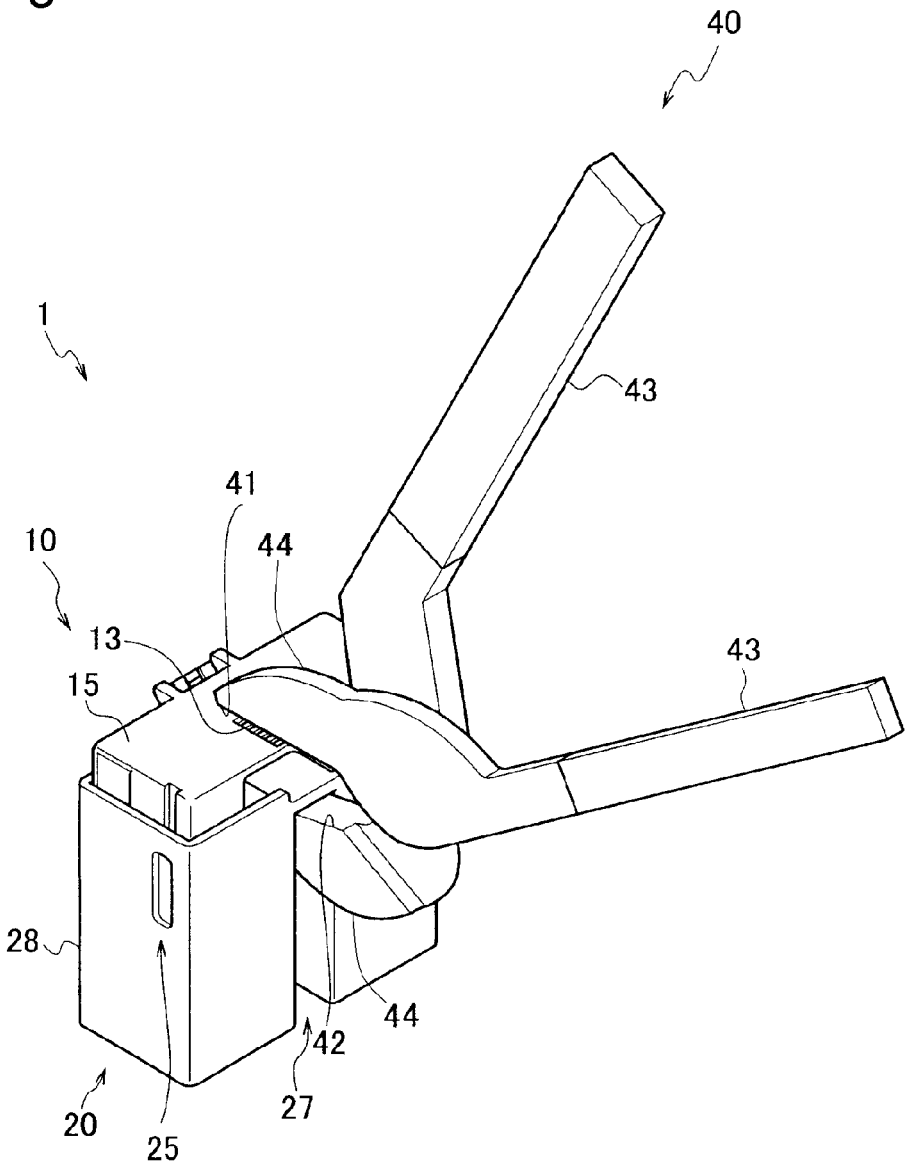
FIG. 5 is a diagram showing that the nipping tool is attached to the temporarily engaged male and female connectors according to the exemplary embodiment of the present invention.
Figure 6:
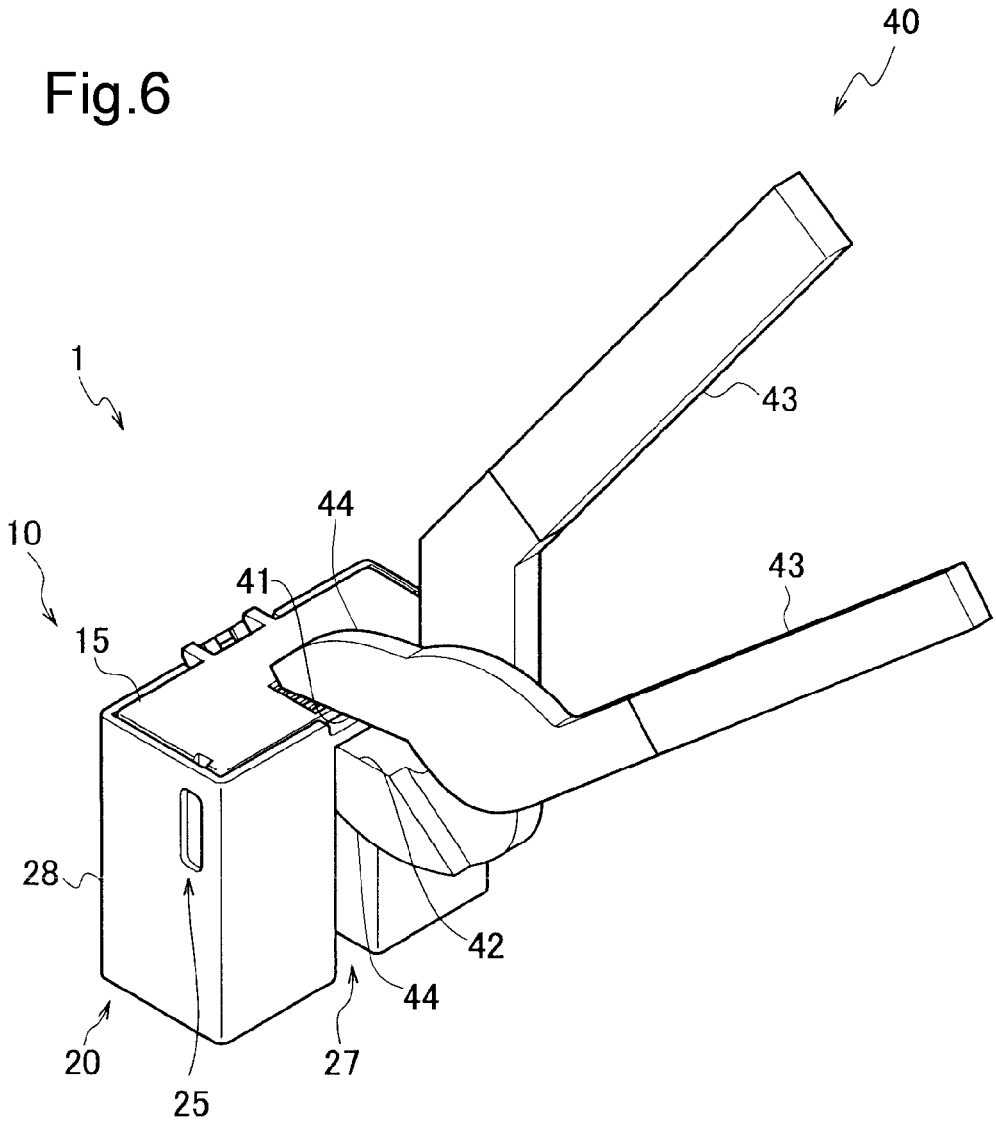
FIG. 6 is a diagram showing that the male and female connectors according to the exemplary embodiment of the present invention are fitted to each other.
Figure 7:
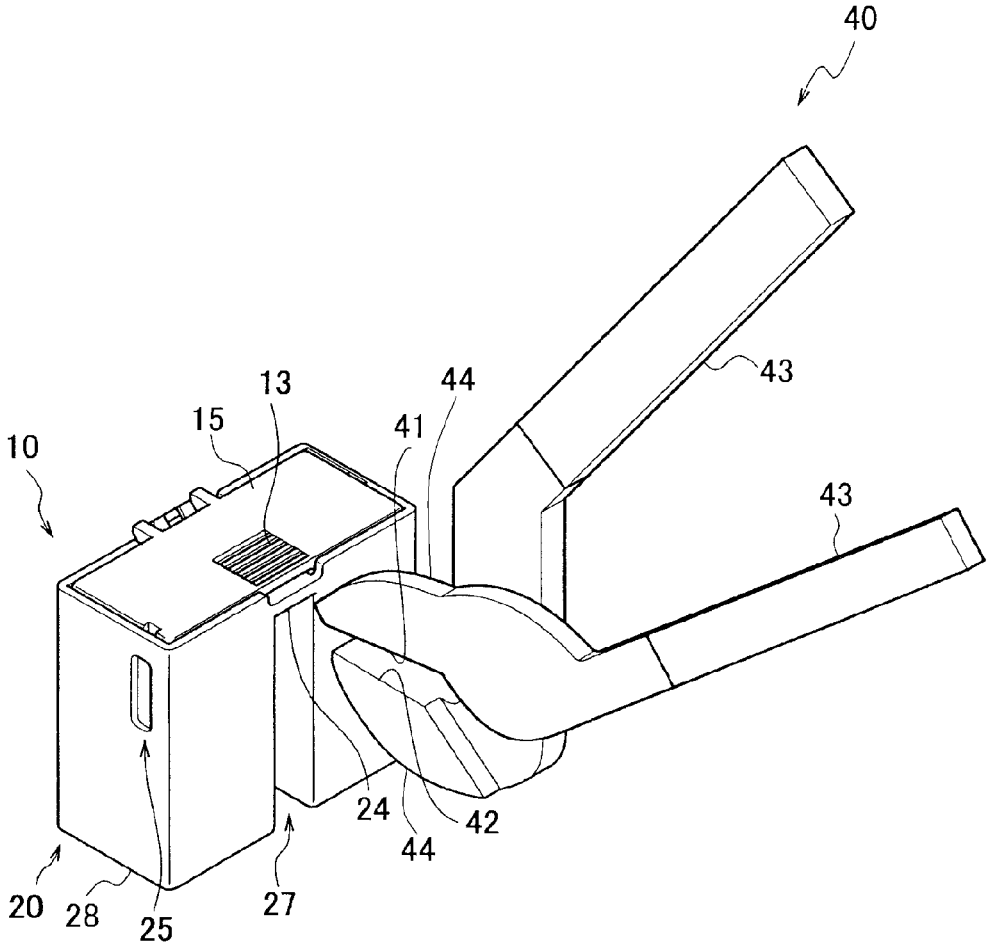
FIG. 7 is a diagram showing that the nipping tool according to the exemplary embodiment of the present invention is detached.
Figure 8:
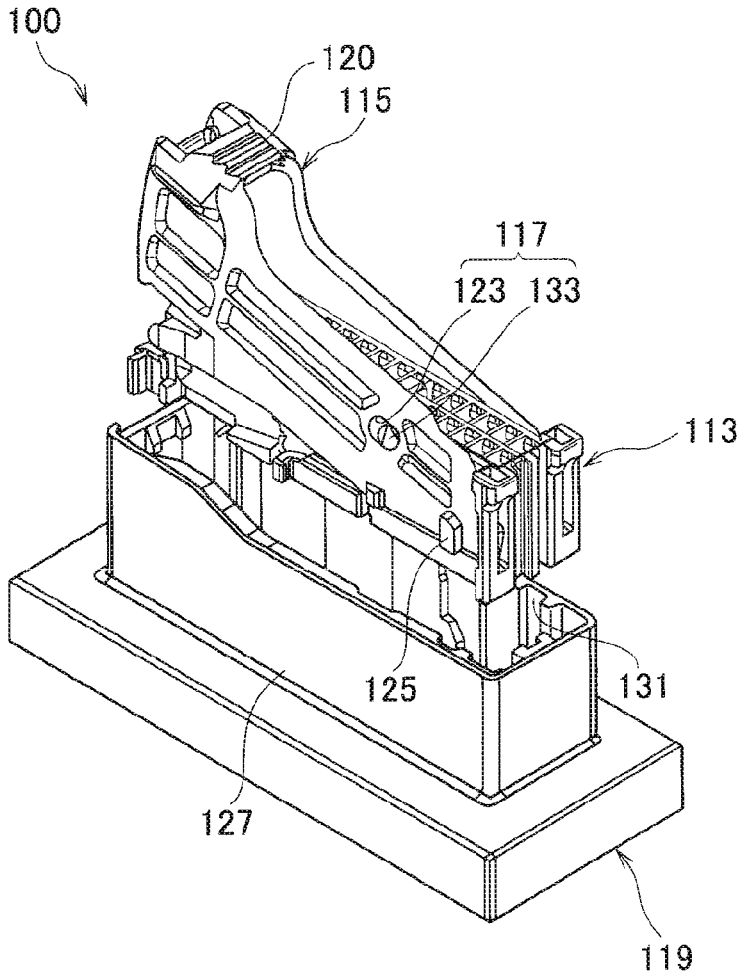
Fig.8 Prior Art
FIG. 8 is a perspective view of a usual lever type connector.
Figure 9:
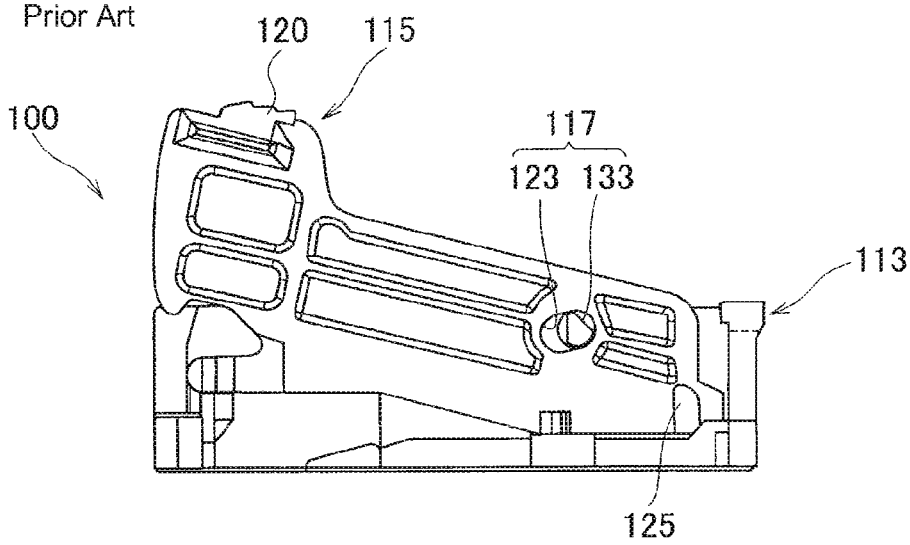
Fig.9 Prior Art
FIG. 9 is a side view of the usual lever type connector.
Figure 10:
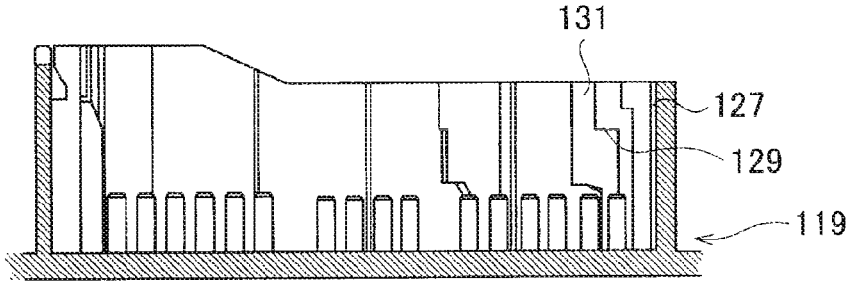
Fig.10 Prior Art
FIG. 10 is a side view of the usual lever type connector.
Figure 11:
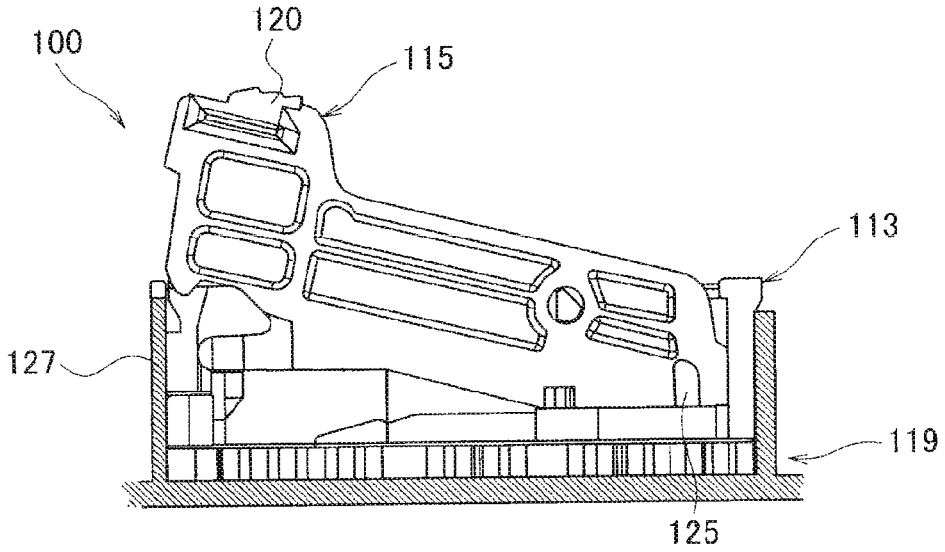
Fig.11 Prior Art
FIG. 11 is a sectional view when a male housing of the usual lever type connector is fitted to a female housing.

Now, an exemplary embodiment of the present invention will be described below by referring to the drawings. FIG. 1 is a perspective view of a nipping tool and a connector according to an exemplary embodiment of the present invention. FIG. 2 is a side view of male and female connectors according to the exemplary embodiment of the present invention. FIG. 3 is a sectional view of the female and male connectors according to the exemplary embodiment of the present invention taken along a line A-A. FIG. 4 is a diagram showing a temporarily engaged state of the male and female connectors according to the exemplary embodiment of the present invention. FIG. 5 is a diagram showing that the nipping tool is attached to the temporarily engaged male and female connectors according to the exemplary embodiment of the present invention. FIG. 6 is a diagram showing that the male and female connectors according to the exemplary embodiment of the present invention are fitted to each other. FIG. 7 is a diagram showing that the nipping tool according to the exemplary embodiment of the present invention is detached.

Initially, by referring to FIG. 1 to FIG. 3, the structure of the connector of the present invention will be described.

As shown in FIG. 1, the connector 1 of the exemplary embodiment of the present invention substantially includes a female connector 10 having a terminal accommodating chamber (not shown in the drawing) in which a terminal is accommodated and a male connector 20 into which the female connector 10 is inserted and fitted. Then, a below-described nipping tool 40 is gripped to fit the female and male connectors 10 and 20 to each other.

The female connector 10 includes a connector main body 15 having a boss part 11 protruding outside, a female temporarily engaging part 12 temporarily engaged with the male connector 20 when the female connector is inserted into the male connector 20, a female side pressure operating surface 13 which receives a force in a fitting direction of the female and male connectors 10 and 20 and has a non-slip worked surface formed on a surface and a fitting recessed part 14 fitted to a below-described fitting part 23.

The male connector 20 includes a connector housing 28 having a terminal accommodating chamber 21 in which a terminal is accommodated, a fitting hood part 22 into which the female connector 10 is inserted and fitted and a fitting part 23 with a protruding part fitted to the fitting recessed part 14.

Further, in the connector housing 28, are provided a male side pressure operating surface 24 which receives a force in a side of the female side pressure operating surface 13 when the female and male connectors 10 and 20 are fitted to each other and has a non-slip worked surface formed on a surface and a male temporarily engaging part 25 (see FIG. 3) formed in the shape of < in the male connector 20 to abut on the female temporarily engaging part 12 so as to temporarily engage the female connector 10 with the male connector 20.

Further, in the connector housing 28, are provided a guide groove part 26 which accommodates the boss part 11 to guide the female connector 10 in a normal fitting direction in order to regulate a position of the inserted female connector 10 and a tool attaching part 27 into which the below-described nipping tool 40 is inserted.

Further, in order to form the female side pressure operating surface 13 and the male side pressure operating surface 24, the tool attaching part 27 is necessary in which the nipping tool 40 is inserted to the female and male connectors 10 and 20. Accordingly, in the exemplary embodiment of the present invention, the female side pressure operating surface 13 and the male side pressure operating surface 24 are formed in substantially central parts of the female and male connectors 10 and 20 by considering an operation that the female and male connectors are fitted to each other. Since the female side pressure operating surface 13 and the male side pressure operating surface 24 are provided at the substantially central parts as described above, when the female connector is fitted to the male connector, the force applied to the female and male connectors 10 and 20 is uniformly applied to fitting surfaces.

As shown in FIG. 1, the nipping tool 40 is what is called pincers and includes a working part 44 having a first working surface 41 which abuts on the female connector 10 when the female connector 10 and the male connector 20 are fitted to each other and a second working surface 42 which abuts on the male connector 20 and a pair of grip parts 43 which are gripped to allow the first working surface 41 to come close to the second working surface 42.

Now, by referring to FIG. 1 to FIG. 3, the temporarily engaged state of the female and male connectors 10 and 20 according to the exemplary embodiment of the present invention will be described below. When the female connector 10 is inserted into the male connector 20, the boss part 11 of the female connector 10 is accommodated in the guide groove part 26 of the male connector 20 to regulate the female connector to a temporarily engaged position. Thus, the female connector 10 is not slanted and moves to the temporarily engaged position in the normal fitting direction. In such a way, in the exemplary embodiment of the present invention, the female connector 10 is fixed to the male connector 20, so that a fitting workability is improved.

As shown in FIG. 2 and FIG. 3, the female and male connectors 10 and 20 are moved to the temporarily engaged position, a lower protrusion of the female temporarily engaging part 12 gets over the male temporarily engaging part 25 and the female temporarily engaging part 12 abuts on the male temporarily engaging part 25, so that the female and male connectors 10 and 20 are held in the temporarily engaged position. Since the female and male connectors 10 and 20 are held in the temporarily engaged position, the nipping tool 40 can be easily attached.

Now, referring to FIG. 4 to FIG. 7, a fitting operation of the female and male connectors 10 and 20 according to the exemplary embodiment of the present invention will be described below.

As shown in FIG. 4, after the female and male connectors 10 and 20 are held in the temporarily engaged position, as shown in FIG. 5, the one pair of grip parts 43 are kept apart from each other so that the first working surface 41 of the nipping tool 40 is allowed to abut on the female side pressure operating surface 13 of the female connector 10, and the second working surface 42 of the nipping tool 40 is allowed to abut on the male side pressure operating surface 24 of the male connector 20. Thus, the nipping tool 40 is attached to the female and male connectors 10 and 20. Since the non-slip worked surfaces are formed on the surfaces of the female side pressure operating surface 13 and the male side pressure operating surface 24, the nipping tool 40 can be allowed to easily abut on the female side pressure operating surface 13 and the male side pressure operating surface 24 and the strength of the female and male connectors 10 and 20 can be improved when the female connector 10 is fitted to the male connector 20.

Further, in the exemplary embodiment of the present invention, since the one pair of grip parts 43 of the nipping tool 40 are kept apart from each other to keep the first working surface 41 away from the second working surface 42 and attach the second working surface 42 from a lower part of the male connector 20, the tool attaching part 27 is formed in the male connector 20. The tool attaching part 27 protrudes inward in the male connector 20. Since the female connector 10 is fitted to the fitting part 23 formed on an upper part of the male connector 20, the fitting recessed part 14 protruding inward is formed. Then, the fitting part 23 of the male connector 20 is fitted to the fitting recessed part 14 of the female connector 10. Since the second working surface 42 is inserted from the lower part of the tool attaching part 27, the nipping tool 40 is easily attached to the female and male connectors 10 and 20.

Then, as shown in FIG. 5, when the one pair of grip parts 43 are gripped, the first working surface 41 comes close to the second working surface 42. When the first working surface 41 comes close to the second working surface 42, the upper surface of the female connector 10 and the upper surface of the male connector 20 are located at the substantially same position. As shown in FIG. 6, the female and male connectors 10 and 20 are fitted to each other.

After the female connector 10 is fitted to the male connector 20, as shown in FIG. 7, the one pair of grip parts 43 are kept apart from each other to keep the first working surface 41 from the second working surface 42 and detach the first working surface 41 and the second working surface 42 from the female side pressure operating surface 13 of the female connector 10 and the male side pressure operating surface 24 of the male connector 20. Thus, the nipping tool 40 is detached from the female and male connectors 10 and 20.

As described above, in the connector 1 of the exemplary embodiment of the present invention, since the female side pressure operating surface 13 is provided in which the first working surface 41 of the nipping tool 40 abuts on the female connector 10 to receive the force in the fitting direction of the female and male connectors 10 and 20. The male side pressure operating surface 24 is provided in which the second working surface 42 of the nipping tool 40 abuts on the male connector 20 to receive a force toward the first working surface 41 side of the nipping tool 40. The first working surface 41 of the nipping tool 40 is allowed to come close to the second working surface 42 to fit the female connector 10 to the male connector 20. Accordingly, after the female and male connectors 10 and 20 are fitted to each other, since the nipping tool 40 is detached from the female and male connectors 10, the weight of component parts of the connector 1 can be reduced.

Further, since the nipping tool 40 is detached after the female and male connectors are fitted to each other, component parts for engaging the nipping tool after the connectors are fitted can be eliminated.

Accordingly, the connector 1 can be provided in which the number of component parts and the weight of the component parts are smaller than the usual lever type connector with the lever kept attached after the female and male connectors are fitted to each other and a production cost can be reduced.

Further, in the connector 1 according to the exemplary embodiment of the present invention, the boss part 11 protrudes in the one female connector 10. In the male connector 20, the guide groove part 26 is formed into which the boss part 11 is inserted to guide the one connector 1 in the normal fitting direction during a fitting operation by the nipping tool 40. Accordingly, the female and male connectors 10 and 20 are not slanted and the female connector is guided along the normal fitting direction. Thus, the fitting workability can be improved.

Further, in the connector 1 according to the exemplary embodiment of the present invention, the female temporarily engaging part 12 which is temporarily engaged with the male connector 20 is provided in the female connector 10. In the male connector 20, the male temporarily engaging part 25 is provided which is engaged with the female temporarily engaging part 12 to hold the female and male connectors 10 and 20 in the temporarily engaged state. Accordingly, since the female and male connectors 10 and 20 are held in the temporarily engaged position, the nipping tool 40 can be easily attached.

Further, in the connector 1 according to the exemplary embodiment of the present invention, the non-slip worked surface is formed on the surface in at least one of the female side pressure operating surface 13 and the male side pressure operating surface 24. Accordingly, the first working surface 41 and the second working surface 42 of the nipping tool 40 can be allowed to easily abut on the female side pressure operating surface 13 and the male side pressure operating surface 24. Further, the strength of the female and male connectors 10 and 20 can be improved when the female and male connectors 10 and 20 are pressed.

As described above, the connector of the present invention is explained in accordance with the exemplary embodiment shown in the drawing. However, the present invention is not limited thereto. Structures of parts may be respectively replaced by arbitrary structures having the same functions.

Further, as the nipping tool 40, any other nipping tools than the above-described exemplary embodiment of the present invention may be used and a marketed pincers may be used.

The present invention is not limited to the above-described exemplary embodiment, and may be suitably modified and improved. In addition thereto, materials, forms, dimensions, numeric values, modes, numbers, arranged positions of component elements or the like in the above-described exemplary embodiment are arbitrary and are not limited, as long as the present invention can be achieved.

The present invention is described in detail by referring to the specific exemplary embodiment, however, it is to be understood to a person with ordinary skill in the art that various changes or corrections may be made without departing from the spirit and scope of the present invention.

This application is based on Japanese Patent Application (JPA No. 2010-012327) filed on Jan. 22, 2010 and contents thereof are incorporated herein as a reference.

INDUSTRIAL APPLICABILITY

In the present invention, since the number of the components parts and the weight of the component parts are small when the connectors are fitted to each other, the present invention is extremely useful for lowering the production cost.

DESCRIPTION OF REFERENCE NUMERALS AND SIGNS

1 . . . connector 10 . . . female connector 11 . . . boss part 12 . . . female temporarily engaging part 13 . . . female side pressure operating surface 14 . . . fitting recessed part 15 . . . connector main body 20 . . . male connector 21 . . . terminal accommodating chamber 22 . . . fitting hood part 23 . . . fitting part 24 . . . male side pressure operating surface 25 . . . male temporarily engaging part 26 . . . guide groove part 27 . . . tool attaching part 28 . . . connector housing 40 . . . nipping tool 41 . . . first working surface 42 . . . second working surface 43 . . . grip part 44 . . . working part

The invention claimed is:

1. A connector having female and male connectors, wherein:

in one connector of the female and male connectors, one pressure operating surface on which a first working surface of a nipping tool abuts to receive a force in a fitting direction of the female and male connectors is provided;

in the other connector of the female and male connectors, another pressure operating surface on which a second working surface of the nipping tool abuts to receive a force in the first working surface side of the nipping tool is provided;

the one connector includes a first recessed part configured to accommodate the other pressure operating surface of the other connector; and the other connector includes a second recessed part configured to accommodate the nipping tool.

2. The connector according to claim 1, wherein a boss part protrudes in one of the female and male connectors, in the other connector, a guide groove part is formed in which the boss part is inserted to guide the one connector in a normal fitting direction during a fitting operation by the nipping tool.

3. The connector according to claim 1, wherein:

in one of the female and male connectors, a female temporarily engaging part is provided;

in the other connector, a male temporarily engaging part is provided; and the male temporarily engaging part is configured to be engaged with the female temporarily engaging part to hold the female and male connectors in a temporarily engaged state.

4. The connector according to claim 1, wherein, in at least one of the one pressure operating surface and the other pressure operating surface, a non-slip worked surface is formed on a surface.

* * * * *